United States Patent [19]

Todorov et al.

[11] 4,439,286

[45] Mar. 27, 1984

[54] ELECTROLYTE FOR THE DEPOSITION OF BRIGHT TIN COATINGS

[75] Inventors: Ivan V. Todorov; Vera V. Mircheva; Stefan R. Stefanov; Ivan M. Todorov, all of Sofia, Bulgaria

[73] Assignee: Edinen Centar Po Chimia, Sofia, Bulgaria

[21] Appl. No.: 398,365

[22] Filed: Jul. 14, 1982

[30] Foreign Application Priority Data

Jul. 14, 1981 [BG] Bulgaria ..... 52924

[51] Int. Cl.[3] ..... C25D 3/32

[52] U.S. Cl. ..... 204/54 R

[58] Field of Search ..... 204/54 R, 43 S, 120, 204/123

[56] References Cited

U.S. PATENT DOCUMENTS 4,139,425 2/1979 Eckles et al. ..... 204/43 S

*Primary Examiner*—G. L. Kaplan

[57] ABSTRACT

An electroplating bath for the deposition of bright tin coatings comprises tin sulphate, sulphuric acid, formalin, benzalacetone, a surfactant of the polyethoxy type and a nicotonic acid type compound. Bright deposits over a wide range of current densities, deposition at high current densities and high throwing power are characteristics of this bath.

1 Claim, No Drawings

ELECTROLYTE FOR THE DEPOSITION OF BRIGHT TIN COATINGS

This invention relates to an electrolyte for the deposition of bright tin coatings applicable in radio-engineering and electronics, the automotive industry, the food industry and the pharmaceutical industry.

There are known additives to electrolytes for the deposition of bright tin coatings which include wetting, brightening and levelling agents. See for example, Fed. Republic of Germany Patent No. 1260262 and U.K. Pat. No. 2023182. The products of condensation between alkyl alcohols or alkyl phenols and ethylene oxide, which contain from 10 to 25 molecules of ethylene oxide are cited broadly as wetting agents. Benzalacetone or a mixture of acetaldehyde or crotonaldehyde with acetone and ammonia is commonly recommended as the brightening agent. Heterocyclic nitrogen containing compounds or their derivatives are used in order to achieve high levelling effect and good throwing power of the electrolyte (Fed. Republic of Germany Patent No. 1246346).

The drawbacks of the well known additives for bright tin coating are as follows: low permissible current densities; reduced rates of deposition; limited bright-range; application of two or more components for adjustment of the electrolyte. Due to the water insolubility of the components of the additive, organic solvents of considerable toxicity are required for the preparation of the additive.

The present invention has among its objects the provision of an electrolyte for the deposition of bright tin coatings using an appropriate water soluble additive so that to ensure brightening over a wide range of current densities, successful operation at high current densities, intensive brightness of the coating with both high throwing power of the electrolyte and a high rate of deposition.

This object is achieved by using as the additive to the electrolyte a derivative of nicotinic acid, having a general formula

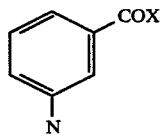

where X is —OH, —$NH_2$, —$O(CH_2CH_2O)_qH$, —$NH(CH_2CH_2O)_pH$, and q, p are integers from 1 to 4, in a concentration from 0.05 to 0.8 g/L, said electrolyte including from 100 to 180 g/l of sulphuric acid; from 20 to 60 g/l of tin sulphate; 4 ml/l of 38% solution of formalin; from 0.2 to 0.8 g/l of benzalacetone as the brightener and from 3 to 15 g/l of surfactant having a general formula $C_nH_{2n}YO(CH_2CH_2O)_mX$ where Y is hydrogen or aryl; X is hydrogen, $SO_2H$ or $SO_3H$; n is from 8 to 18; and m is from 4 to 25.

The electrolyte according to the invention provides for bright (i.e. 82% against 100% for a silver mirror), well levelled tin coatings, deposited over a wide range of current densities (i.e. from 1 to 10 A/dm$^2$). The nitrogen containing compound, which is a derivative of nicotinic acid and serves as the additive, is completely soluble both in water and in the electrolyte, and contributes to the high throwing power of the electrolyte (i.e. 42%). Due to this fact, the electrolyte of the invention is generally applicable and can be operated both in steady-state baths and in barrels, irrespective of the complex shape of the parts being coated. Organic solvents are avoided, and the electrolyte adjustments in the course of operation are made by using a single solution which is technologically most feasible. The composition of the electrolyte is a simple one, easy to prepare in its application, and possesses stability both during operation and storage for a period of 24 months.

The following examples throw more light on the invention:

EXAMPLE 1

The composition of the electrolyte for deposition of bright tin coatings is as follows:

tin sulphate: 20 g/l
sulphuric acid: 100 g/l
formalin (38%): 4 ml/l
non-ionogenic surfactant bearing 10 —$CH_2CH_2O$— groups: 7.5 g/l
benzalacetone: 0.2 g/l
hydroxyethylated nicotin amide: 0.05 g/l The electrolyte operates at a temperature of from 15 to 25 degrees C., and the current density is 4 A/dm$^2$. The rate of deposition is 2.6 microns/min. The brightness of the coating is 72% against 100% for a silver mirror. The throwing power of the electrolyte is 18%.

EXAMPLE 2

The composition of the electrolyte for deposition of bright tin coatings is as follows:

tin sulphate: 40 g/l
sulphuric acid: 120 g/l
formalin: 4 ml/l
non-ionogenic surfactant bearing 15 —$CH_2CH_2O$— groups: 7.0 g/l
benzalacetone: 0.3 g/l
hydroxyethylated nicotinic acid: 0.1 g/l The coating is deposited under the same conditions as those in Example 1. The throwing power of the electrolyte is 33%; the brightness of the coating is 89% against silver mirror in a wide range of current densities. The rate of deposition is 2.0 microns/min.

EXAMPLE 3

The composition of the electrolyte is as follows:

tin sulphate: 60 g/l
sulphate acid: 180 g/l
formalin: 4 ml/l
non-ionogenic surfactant bearing 15 —$CH_2CH_2O$— groups: 7.5 g/l
benzalacetone: 0.3 g/l
hydroxyethylated nicotin amide: 0.2 g/l The coating is deposited under the same conditions as those in Example 1. The throwing power of the electrolyte is 36%. The coated parts have a good appearance, and show no pitting or any flaws.

EXAMPLE 4

The composition of the electrolyte is as follows:

tin sulphate: 40 g/l
sulphuric acid: 160 g/l
formalin: 4 ml/l
non-ionogenic surfactant bearing 25 —$CH_2CH_2O$— groups: 7 g/l
benzalacetone: 0.5 g/l
hydroxyethylated nicotinic acid: 0.3 g/l The coating is deposited under the same conditions as those in Example 1. The throwing power of the electrolyte is 42% with an 83% brightness.

Although the invention is illustrated and described with reference to a plurality of embodiments thereof, it is to be expressly understood that it is in no way limited to the disclosure of such preferred embodiments but is capable of numerous modifications within the scope of the appended claims.

We claim:

1. Electrolyte for the deposition of bright tin coatings, which is composed of sulphuric acid in a concentration from 100 to 180 g/l; tin sulphate in a concentration from 20 to 60 g/l; formalin in a concentration of about 4 ml/l, benzalacetone in a concentration 0.2 to 0.8 g/l and surfactant of a general formula $C_nH_{2n}YO(CH_2CH_2O)_mX$ where Y is hydrogen or aryl, X is H, $SO_2H$ or $SO_3H$, n is a number from 8 to 18, m is a number from 4 to 25, in a concentration from 3 to 15 g/l, comprising in that said electrolyte includes also a derivative of the nicotinic acid of the general formula

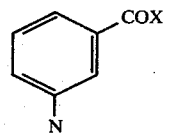

where X is —OH, —$NH_2$, —$O(CH_2CH_2O)_qH$, —$NH(CH_2CH_2O)_pH$, and q, p are integers from 1 to 4, in a concentration from 0.05 to 0.8 g/l.

* * * * *